United States Patent [19]

Trombettas

[11] Patent Number: 4,606,145

[45] Date of Patent: Aug. 19, 1986

[54] SHUTTER-TYPE WINDOW PANEL

[76] Inventor: David T. Trombettas, 41-35 45th St., Long Island City, N.Y. 11104

[21] Appl. No.: 654,938

[22] Filed: Sep. 27, 1984

Related U.S. Application Data

[63] Continuation-in-part of Ser. No. 375,403, May 6, 1983, abandoned.

[51] Int. Cl.[4] ..... E06B 3/68

[52] U.S. Cl. ..... 49/57; 292/189; 49/395

[58] Field of Search ..... 49/56, 57, 394, 392; 292/150, 153, 183, 189, 175

[56] References Cited

U.S. PATENT DOCUMENTS 2,587,695 3/1952 Citso ..... 292/153 X 3,160,927 12/1964 Busillo ..... 49/57

4,249,345 2/1981 Littleton ..... 49/56

*Primary Examiner*—Kenneth Downey

*Attorney, Agent, or Firm*—Sheldon Palmer

[57] ABSTRACT

A shutter-type window gate device has a hinged shutter panel defining a vertical guide at its unhinged side for guiding a vertical slidable bolt. The vertical slidable bolt is adapted to engage latch elements on the frame of the device in a locked upper position of the bolt. The vertical slidable bolt has a horizontal latching projection to adapted to engage the top of a horizontal resiliently biased bolt, in the locked upper position of the slidable bolt, thereby holding the vertical slidable bolt in its locked position. In the lower, unlocked, position of the vertical slidable bolt, its latching projection is aligned with the resiliently horizontally biased bolt, to enable free vertical movement of the slidable bolt by an operator.

10 Claims, 8 Drawing Figures rectangular, and is comprised of a bottom angle iron 13, a top angle iron 14, and side angle irons 15 and 16 affixed together, preferably by welding. One leg of each of the angle irons is generally parallel to the corresponding member of the frame of the building into which the window gate is to be mounted, and the other legs thereof are in a common plane of the window gate directed toward the double hung window. The window gate is accordingly mounted on the interior of the window. In order to firmly hold the window gate in the frame of the building, a pair of pins 18 are welded to the top of the upper angle iron 14 to extend upwardly, and into mating holes formed in the upper member of the window frame. The bottom angle iron 13 rests on the window sill 19, and is held thereon by screws 20 extending through the bottom angle iron 13 and into the sill.

While the above technique for mounting the window gate of the invention in a window frame is particularly advantageous, it is apparent that other mounting techniques may be employed without departing from the invention.

As illustrated in FIG. 1, the upper portion of the window gate is comprised of a plurality of fixed shutters or louvers 25 extending between and, for example, welded to the side angle irons 15 and 16. A central angle iron 26 extends between the angle irons 15 and 16, below the louvers 25, and is preferably welded to the side angle irons. As illustrated more clearly in FIGS. 2 and 6, one leg of the central angle iron 26 is in a horizontal plane, and the other leg is in the plane defined by the legs of the frame angle irons toward the double hung window. The central angle iron 26 is provided with a downwardly extending latch element 27 at its inner (away from the window) side, generally centrally between its ends.

The window gate in accordance with the invention is provided with a pair of shutter panels 30, 31 pivotaly mounted to the side angle irons 15 and 16 respectively by hinges 32 and 33 respectively. The two shutter panels substantially fill the open space in the frame between the central angle iron 26 and the bottom angle iron 13, each of the shutter panels having a size to fill approximately one half of this open space. The shutter panels are generally rectangular, and having a frame fabricated, for example, of angle iron. Thus, the shutter panels 30 and 31 each have a bottom angle iron 34, a top angle iron 35, a hinge side angle iron 36 to which the respective hinge is connected, and a central angle iron 37. The angle irons of the shutter panels are oriented generally in the same manner as the angle irons of the frame of the window gate, and each of them has a plurality of shutters or louvers 39 extending between its side angle irons and preferrably welded thereto.

As illustrated more clearly in FIG. 4, a vertical channel 40 is affixed to the side of the central vertical angle iron 37 of the shutter panel 31, the channel 40 being preferably welded to the angle iron 37 and extending almost to the angle iron 37 of the shutter panel 30, defining a gap therebetween. The open side of the vertical channel 40 is directed inwardly (away from the window). The vertical channel 40 extends substantially the height of the shutter panel 31 as illustrated in FIGS. 2 and 6. As illustrated in FIG. 4, a vertical plate 41 is welded to the face of the shutter panel 30 toward the double hung window, the plate 41 extending to engage the corresponding side of the shutter panel 31 when the shutter panels are in closed position. As apparent in FIGS. 2 and 6, the plate 41 extends substantially the height of the shutter panel 30. As is further apparent in FIG. 8, the plate 41 prevents opening of the shutter panel 30 unless the shutter panel 31 is open.

A similar plate 42 is affixed to the face of the shutter panel 31 away from the double hung window, for example, by welding the plate 42 extending across the open side of the channel 40 and into engagement with the corresponding side of the other shutter panel 30. The plate 42 extends from the top of the shutter panel 31, but does not extend downwardly to the bottom shutter panel as illustrated in FIGS. 1, 2, 5 and 6. A handle 43 (FIGS. 1 and 8) is provided on the plate 42 to enable opening of the shutter panel 31.

The channel 40 and plate 42 define a vertical guide way for guiding a vertical slidable bolt 45 which, as illustrated may have a square cross-section. As illustrated in FIG. 2, in the locked position of the window gate, the vertical slidable bolt 45 is adapted to be moved to an upper position, with its upper end behind the latch element 27, to prevent opening of the shutter panel 31. The slidable bolt 45 further has a horizontal projection 46 at its lower end, directed toward the shutter panel 30. In the upper position of the slidable bolt 45, the projection 46 engages a hook 47 rigidly affixed, as by welding, to the lower angle iron 13 of the frame 10. The engagement of the projection 46 in the hook 47 prevents opening of the bottom shutter panel 31, whereby the shutter panel 31 is firmly held at both its upper and lower ends.

As illustrated in FIGS. 6 and 7, however, the slidable bolt 45 is movable to a lower position at which its upper end is below the latch element 27, and at which its lower projection 46 is released from the hook 47, so that, in the lower position of the slidable bolt 45, the shutter panel 31 may be hinged open. It is of course apparent that a portion of the lower corner of the shutter panel 30 may be notched as illustrated in FIGS. 3 and 7, to provide clearance for the hook 47. The slidable bolt 45 is further provided with an operating handle 49 extending inwardly of the slidable bolt and affixed thereto as by welding. The handle 49 projects from the slidable bolt 45 below the plate 42 as apparent in FIGS. 2 and 6.

In order to enable latching of the vertical slidable bolt in its upper, locked, position, a latch mechanism 50 is provided affixed to the the lower edge of the shutter panel 31. The latch mechanism 50 is comprised of a metal box having a top 51 and sides 52 and 53, the top 51 being spaced below the handle 49 to permit movement of the slidable bolt 45 between its upper and lower position. The side 52 is in the plane of the side of the channel 40 toward the shutter panel 30 as illustrated in FIG. 4, the side 53 being spaced therefrom a sufficient distance to enable the box to contain the latch elements. The box 50 need not have a bottom, as illustrated in FIGS. 2 and 6. The box 50 need not have a bottom, as illustrated in FIGS. 2 and 6. The box is further provided with a door 54 pivoted under the top 51 by horizontal hinge 55, so that it may assume a closed vertical position as illustrated in FIG. 2 and an open horizontal position as illustrated in FIG. 6. The door 54 is provided with a handle 55 to enable movement between these positions. Since the latch elements are confined within the box, it is necessary to shield the structure to inhibit gaining entry to the box from the outside of the window gate. For this purpose, the lower portion of the inside of the shutter panel 31 is covered by a plate 56 welded thereto, the plate 56 extending between the box and the shutter panel as illustrated in FIG. 4. The box may be further

SHUTTER-TYPE WINDOW PANEL

This application is a continuation-in-part of my application Ser. No. 375,403 for "Improved Window Gate Apparatus" filed May 6, 1983, now abandoned.

This invention relates to shutter-type window gate devices such as employed for example, to prevent unauthorized entry through the window opening of a building.

BACKGROUND OF THE INVENTION

The ever increasing desire for security against unauthorized entry has lead to a need for an improved window gate device for the protection of both commercial and residental buildings. In order to be acceptable, a window gate device must combine the diverse requirements of providing a high degree of security against unauthorized entry from outside the building with ease of egress from inside the building. In order to insure that the window gate device may be used effectively, the operation of locking and unlocking the device must be simple and fool proof; the operation of unlocking the device being especially critical. The operation of unlocking the device must be simple and straight-forward so that the device can be easily operated by all persons who may have occasion to be inside the building. The device must be easily operated by children as well as by elderly or infirm persons, especially situations when rapid exit from a building is necessary. The device must function with a high degree of reliability so that the operation of opening the gate from the inside is not impaired even in the most extreme circumstances by either a mechanical failure of the device or by a complex mode of operation which is difficult to accomplish.

The increased interest in encorporating a window gate device in the windows of dwellings as well as in commercial offices has also resulted in a desire for a window gate which is more aesthetically pleasing than the conventional window gates which comprise arrangements of metal bars and grates. This desire for a pleasant appearance when viewed from the inside of the building, with the need for simple construction and simple and reliable operation has lead to the rejection of window gates known in a prior art. Known window gate structures are disclosed, for example, in the U.S. Pat. Nos. 980,535; 1,438,202; 1,633,848; 1,855,865; 3,953,939 and 4,070,048. Devices such as shown in these patents may be characterized by complexity of design and construction, and or by the use of a grill work of bars which result in a generally unsatisfactory appearance for a dwelling for an office. Further known under gates are disclosed for example in U.S. Pat. Nos. 4,249,345 and 4,384,428.

SUMMARY OF THE INVENTION

The invention is therefore directed to the provision of a shutter type window gate device which may be economically and simply fabricated, which provides a high degree of security against unauthorized entry from outside the building while providing ease of egress from inside the building, and which is aesthetically pleasing.

Briefly stated, in accordance with the invention, a shutter-type window gate is provided comprised of at least one shutter panel hinged in a frame. The unhinged side of the shutter panel defines a vertical guide for a slidable bolt engagable, in its locked, upper, position, with a latching projection of the frame at its upper end, and a latching hook affixed to the frame, at its lower end. The vertical slidable bolt is held in its locked, upper, position by engagement with a horizontal projection of the slidable bolt with a resiliently biased horizontally extending bolt of a latch mechanism. An operating device for the latch mechanism effects release of the engagement between the bolt thereof and the projection of the vertical slidable bolt, to permit the vertical slidable bolt to drop by gravity, thereby releasing it from its upper and lower latches. In the lower, unlocked position of the vertical slidable bolt, the latching projection thereof is in alignment with the resiliently biased horizontal bolt, thereby preventing any latching effect of the resiliently biased bolt upon movement of the slidable bolt to its, upper locked position. As a consequence, locking of the window gate, upon closure of the shutter panel, requires merely the lifting of the vertical slidable bolt to its upper, locked, position.

In a preferred embodiment of the invention, the window gate device is comprised of two shutter panels one of which, as described above, is provided with a latching mechanism. The other shutter panel is provided with a plate that has an unhinged side adapted to engage the corresponding side of the first shutter panel in closed position, so that neither shutter panel can be hinged open in a locked position of the sliding bolt. Since the shutter panel of the invention is provided with its own frame, it may be readily assembled in a existing window opening. In a preferred arrangement, the frame of the window gate has projections on its upper end for engaging corresponding recesses in the window frame of the building, the bottom elements of the frame resting on the sill of the window opening and being affixed thereto by conventional means.

BRIEF DESCRIPTION OF THE DRAWINGS

In order that the invention may be more clearly understood, it will now be disclosed in greater detail with reference to the accompanying drawings, wherein.

DETAILED DISCLOSURE OF THE INVENTION

Figure 1:
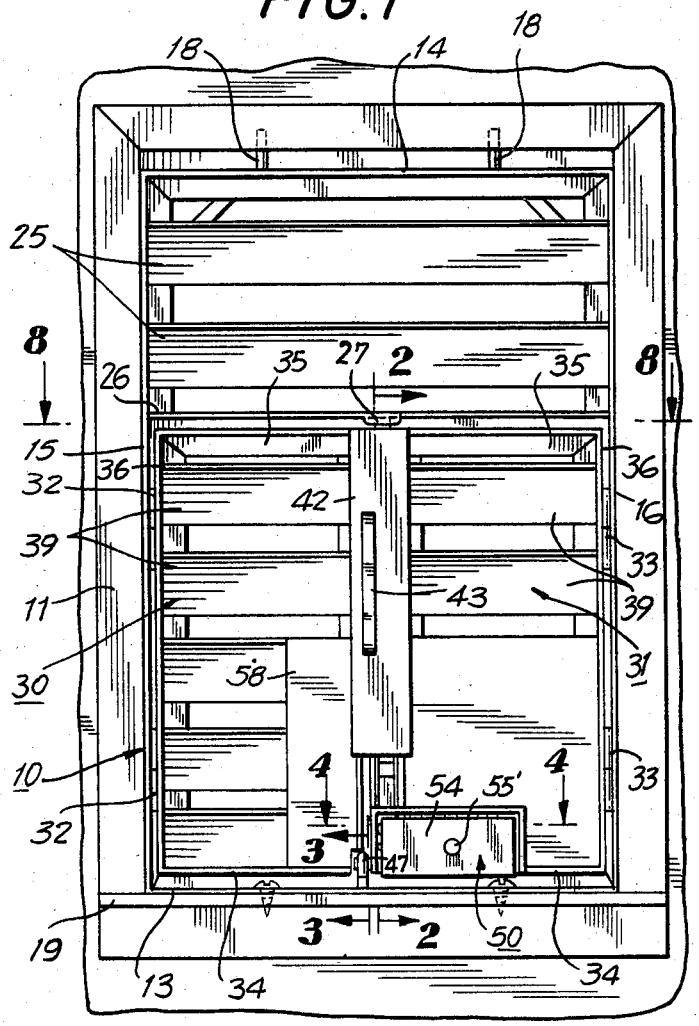
FIG. 1 is a front elevation view of a shutter-type window gate in accordance with the invention, illustrated as mounted in the window frame opening of a building.
Figure 2:
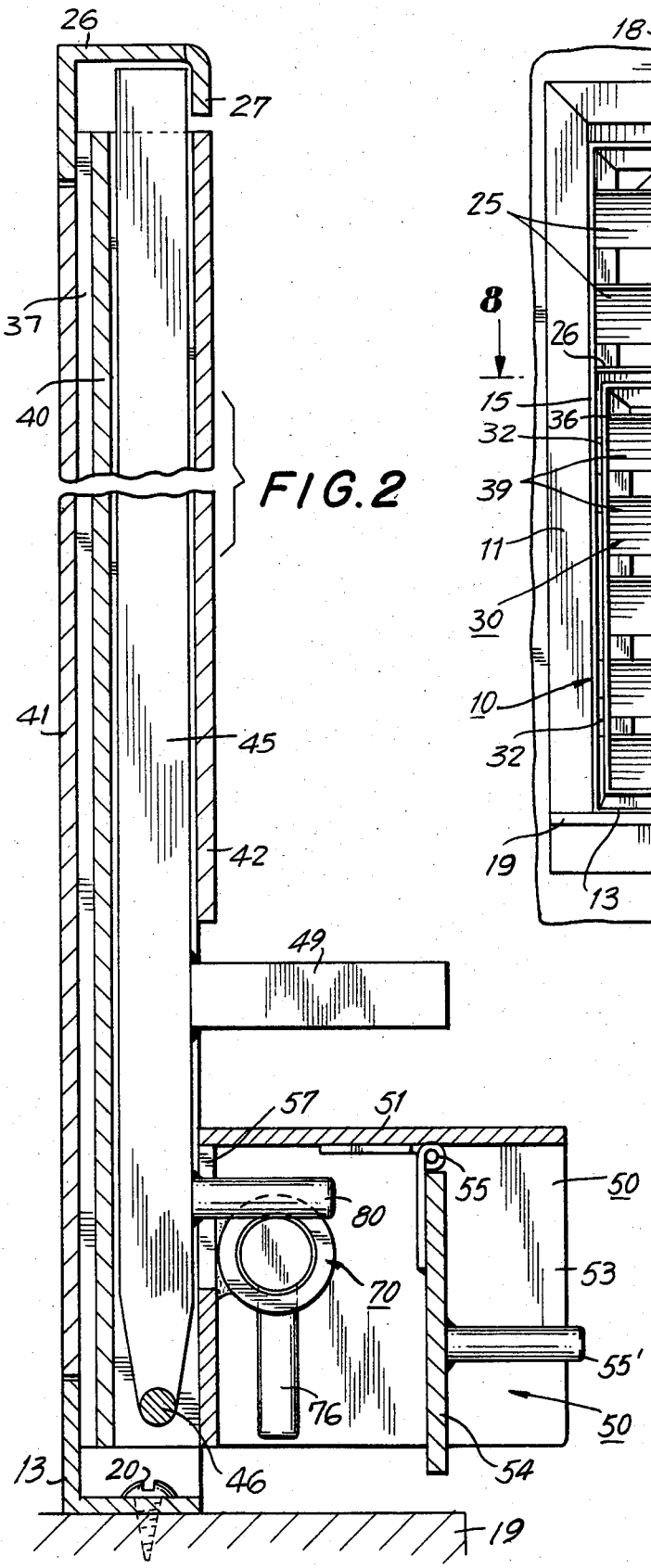
FIG. 2 is a cross-sectional view of a portion of the window gate of FIG. 1 taken along the lines 2—2, the window gate being in the locked postion.
Figure 3:
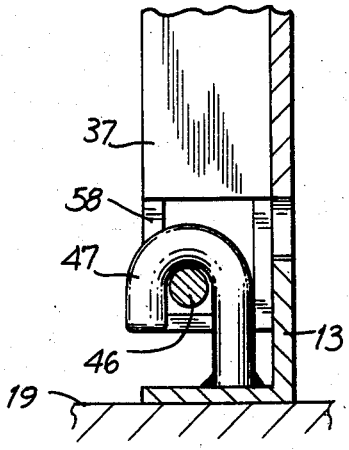
FIG. 3 is a cross-sectional view of a portion of the window gate of FIG. 1 taken along the lines 3—3, with the window gate in the locked position.
Figure 4:
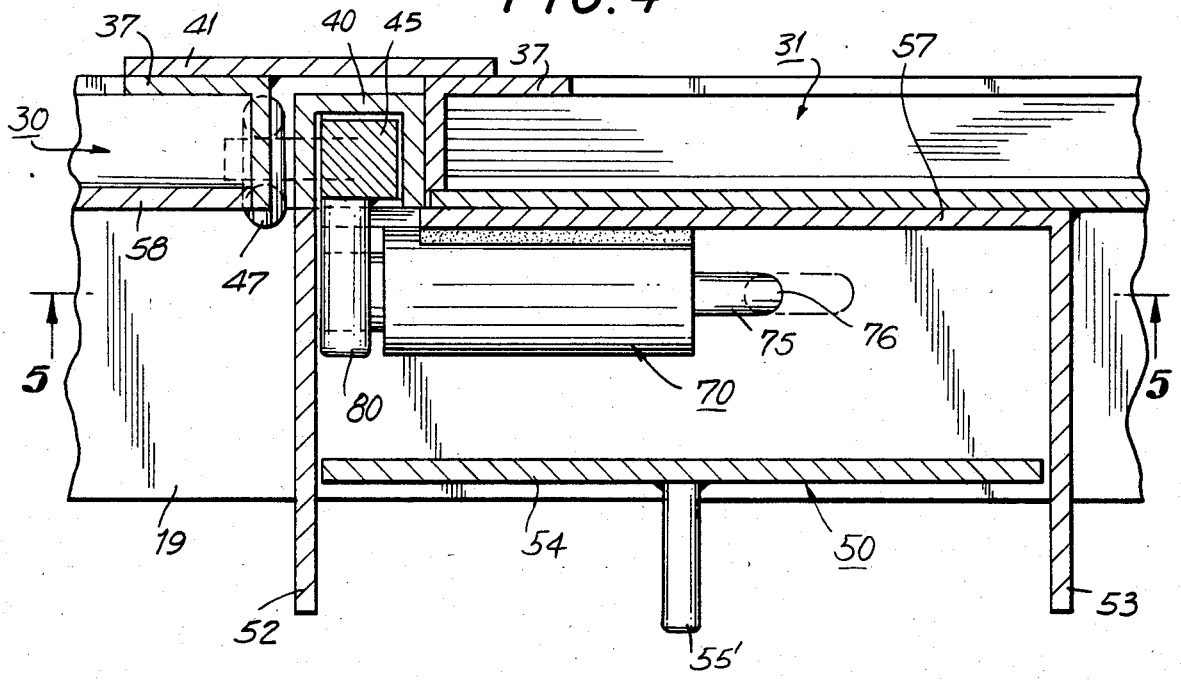
FIG. 4 is a cross-sectional view of a portion of the window gate of FIG. 1 taken along the lines 4—4.
Figure 6:
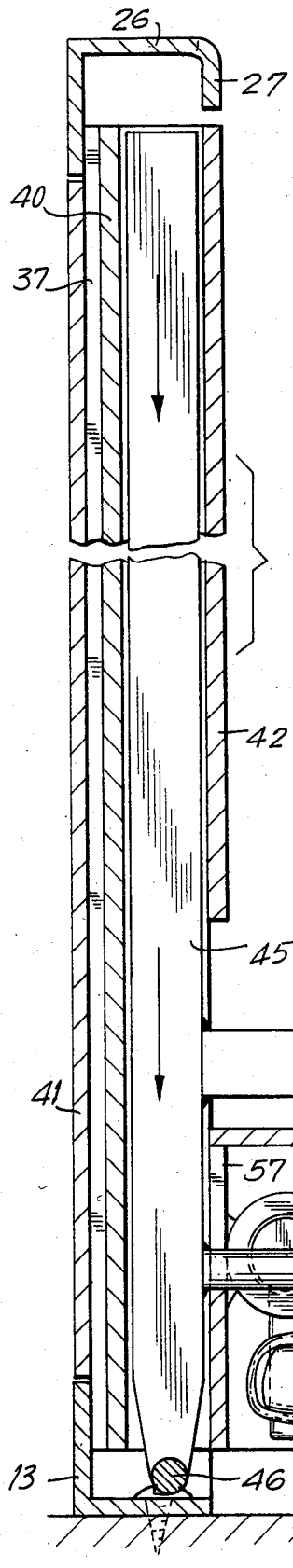
FIG. 6 is a cross-sectional view of the window gate of the invention, corresponding to that illustrated in FIG. 2, with the window gate in unlocked position.
Figure 8:
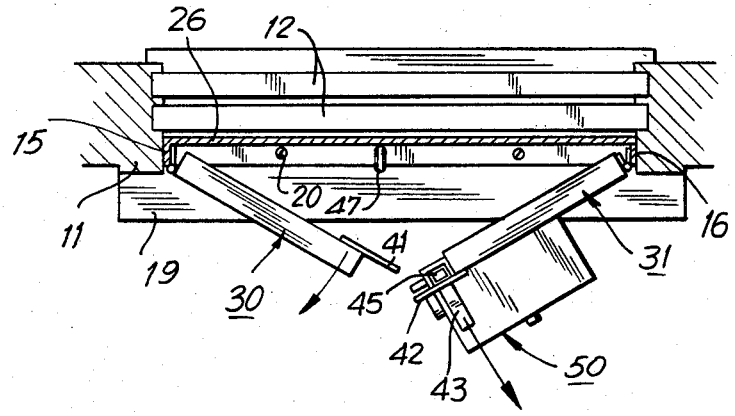
FIG. 8 is a cross-sectional top view of the window gate of the invention, taken along the lines 8—8 of FIG. 1.
Figure 7:
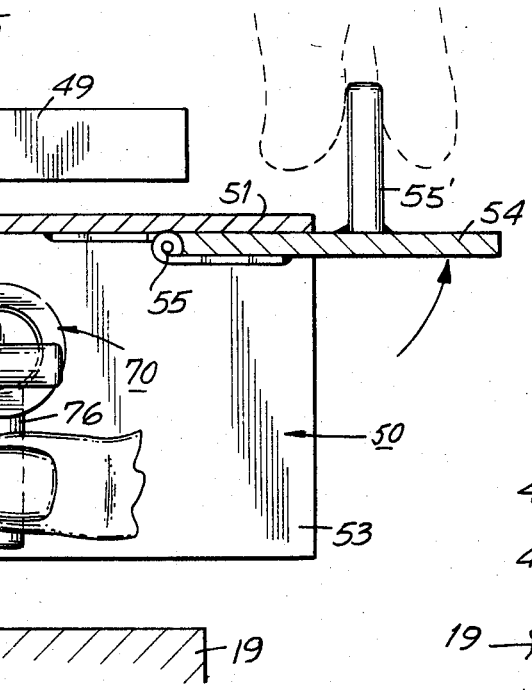
FIG. 7 is a cross-sectional view of the window gate of the invention corresponding to FIG. 3, with the window gate in the unlocked position.
Figure 7:
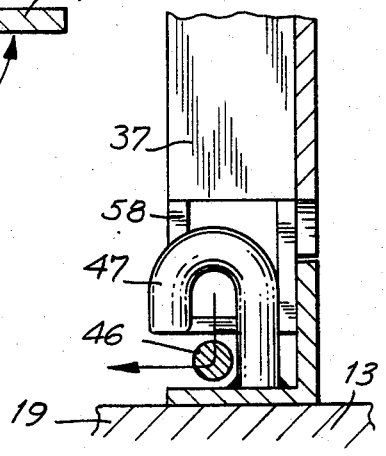

Referring now to the drawings, the window gate of the invention is comprised of a frame 10 adapted to be mounted in the frame 11 of a double hung window 12 as illustrated in FIGS. 1 and 8. The frame 10 is generally provided with a rear wall 57 as illustrated in FIGS. 2, 4 and 6. In addition, for the same purpose, a plate 58 is welded to at least a portion of the lower part of the shutter panel 30, in the region of the box 50.

Figure 5:
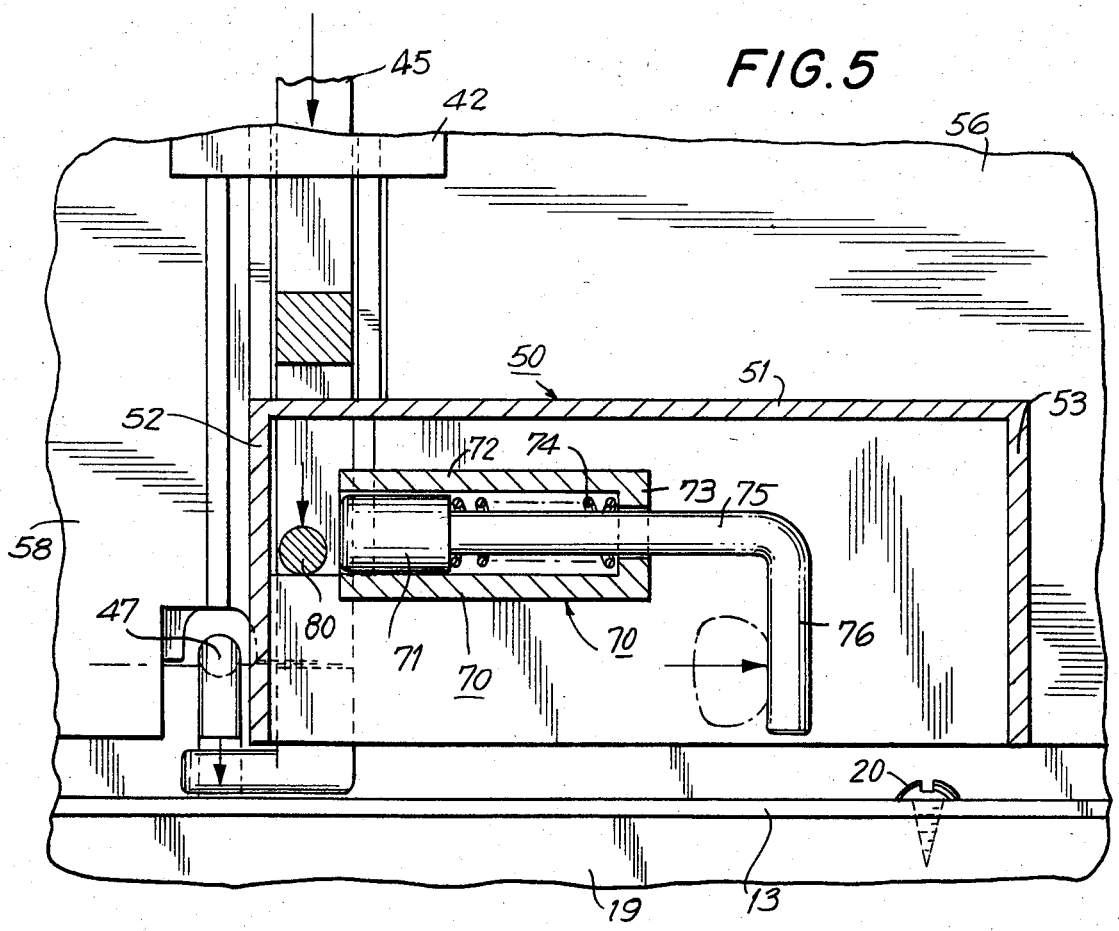
FIG. 5 is a cross-sectional view of a portion of the window gate of FIG. 4 taken along the lines 5—5.

The latching mechanism is further comprised of a spring bolt 70 mounted in the box 50. The spring bolt is comprised of a bolt 71 mounted in a cylinder 72, the cylinder 72 having one closed end 73. A spring 74 in the cylinder, extending between the bolt 71 and closed end 73, biases the bolt toward the open end of the cylinder 72. An operating handle 75 for the spring bolt extends from the bolt 71 through an aperture in the closed end 73 of the cylinder 72, the end 76 of the handle 75 being bent to enable its engagement by the finger of an operator. As illustrated in FIG. 5, the cylinder 72 is oriented horizontally, with its open end, in the vicinity of the vertical slidable bolt 45. The vertical bolt 45 has a horizontal latch projection 80 affixed thereto, and extending in the box 50, as illustrated in FIGS. 2, 4, 5 and 6. In the locked position of the slidable bolt 45, as illustrated in FIGS. 2 and 4, the latch projection 80 is above the bolt 71 of the spring bolt, so that the resiliently horizontal movable bolt 71 may move under the latch projection 80 to abut the side 52 of the box. In this position, the bolt 71 blocks downward movement of the slidable bolt 45 from its locked position.

In the lower, unlocked, position of the slidable bolt 45, the latch projection 80 is aligned generally with the bolt 71, so that the bolt 71 cannot prevent vertical movement of the sliding bolt 45.

In order to explain the operation of the window gate of the invention, it is initially assumed that the slidable bolt 45 is in its upper most position, as illustrated in FIG. 2. In this position the upper end of the slidable bolt engages the upper latch projection 27, and the lower projection 46 of the slidable bolt engages the hook 47, to prevent opening of the shutter panels. The horizontally movable bolt 71 projects under the latch projection 80 to prevent downward movement of the slidable bolt 45. The other shutter panel 30 cannot be opened at this time since its plate 41 extends behind the shutter panel 31. In order to open the window gate, the operator may raise the door 54 of the box 50, as illustrated in FIG. 6. When the door is thus open, the operator may reach inside of box 50 and engage the handle 75, as illustrated in FIG. 5, to withdraw the bolt 71 against the force the spring 74. This releases the support of the latch projection 80 by the bolt 71, so that the slidable bolt 45 may fall towardly under the force of gravity, to its unlocked position as illustrated in FIG. 6. The shutter panel 31 may thus now be opened, followed subsequently by the opening of the shutter panel 30, as illustrated in FIG. 8.

In order to lock the shutter panels, once they have been closed, it is only necessary for the operator to lift the handle 49 until the slidable bolt 45 is raised to its locked position as illustrated in FIG. 2. In this position of the slidable bolt 45, the latch projection 80 of the slidable bolt clears the top of the horizontally biased bolt 71, so that the bolt 71 snaps under the latch projection 80, to latch the slidable bolt 45 in its upper, locked, position.

It is therefore apparent that the window gate of the invention may be economically and simply fabricated, and easily operated, while still providing a high degree of security against unauthorized entry from outside of the building.

While the invention has been disclosed and described with reference to a single embodiment it is apparent that variations and modifications may be made therein without departing from the invention. Thus, the shapes and forms of the different elements of the invention, and their manner of interconnection, may be varied. It is therefore intended in the following claims to cover each such variation and modification as falls within the true spirit and scope of the invention.

What is claimed is:

1. In a shutter-type window gate device for mounting in a window opening of a building and including a first shutter panel, means pivotally mounting the first shutter panel in the window opening on a vertical axis to permit opening and closing of the shutter panel, and bolt means for locking the first shutter panel in a closed position; the improvement wherein said device comprises a rectilinear frame for mounting in said window opening and means for affixing said frame in said window opening, said means for affixing comprising projection means extending upwardly from said angle iron frame and adapted to be received in corresponding recesses of said window opening; means hinging a first side of said first shutter panel to one side of said frame for pivoting about a vertical axis, a vertical guide in the second side of said shutter panel opposite said first side, said bolt means comprising a vertically slidable bolt in said guide and having an upper position and a lower position, projection means on said frame positioned to engage said slidable bolt in said upper position to inhibit opening of said first shutter panel and to clear said slidable bolt in said lower position to enable opening of said first shutter panel, the projection means on said frame comprising downwardly extending latch patch means depending from the top of the frame, and hook means affixed to the bottom of the frame, said slidable bolt means including a lower projection engageable with said hook means when said slidable bolt is in said upper position, a horizontally movable resiliently biased bolt mounted on said first shutter panel, and a latching projection on said slidable bolt, said latching projection being positioned to extend above said resiliently biased bolt in said upper position of said slidable bolt, whereby said latching projection engages the top of said resiliently biased bolt to hold said slidable bolt in said upper position of said slidable bolt, said latching projection being horizontally aligned with said resiliently biased bolt in said lower position of said slidable bolt, whereby said resiliently biased bolt is inhibited from blocking vertical movement of said slidable bolt in said lower position of said slidable bolt.

2. The window gate device of claim 1 wherein said vertical guide comprises a channel affixed to said second side of said first shutter panel, said channel being open toward one face of said first shutter panel, and a plate partially covering said open side.

3. The window gate device of claim 1 further comprising a box affixed to one face of said first shutter panel adjacent the bottom thereof and said second side thereof, said box having a hinged cover on the side thereof away from said first shutter panel, said resiliently biased bolt means being mounted in said box, said box having an aperture in the side thereof affixed to said first shutter panel for receiving said latching projection of said slidable bolt.

4. The window gate device of claim 3 further comprising plate means affixed to said one face of said first shutter panel for inhibiting access to said box from the other face of said first shutter panel.

5. The window gate device of claim 3 wherein said resiliently biased bolt means comprises a horizontal cylinder affixed within said box, a horizontal bolt in said cylinder, a spring in said cylinder biasing said horizontal bolt outwardly of said cylinder, and manually operable handle means coupled to said horizontal bolt enabling control of movement of said horizontal bolt in said cylinder.

6. The window gate device of claim 5 wherein said guide comprises a channel affixed to said second side of said first shutter panel and having an open side toward said one face, and a plate partially covering said open side and being spaced upwardly of said box, and further comprising a handle means affixed to said slidable bolt and extending through said open side of said channel between said box and plate.

7. The window gate device of claim 6 wherein said first shutter panel has louvers extending horizontally thereacross.

8. The window gate device of claim 3 further comprising a second shutter panel, one side of each of said first and second shutter panels being hinged to opposite sides of said frame, the second side of said second shutter panel extending substantially to said first shutter panel to define a gap therebetween, and further comprising a plate affixed to a face of said second shutter panel and bridging said gap to engage the face of said first shutter panel opposite said face, in the closed position of said shutter panels.

9. The window gate device of claim 8 whereing said guide comprises a channel affixed to said second side of said first shutter panel, the open side of said channel being at said one face, and a cover plate partially covering said open side and engaging the corresponding face of said second shutter panel in the closed position of said shutter panels.

10. The window gate device of claim 9 further comprising a handle affixed to said cover plate to enable opening of said first shutter panel.

* * * * *